United States Patent [19]

Francis et al.

[11] 4,417,972

[45] Nov. 29, 1983

[54] RECOVERY OF COAL LIQUEFACTION CATALYSTS

[75] Inventors: James N. Francis; Lavanga R. Veluswamy, both of Houston, Tex.

[73] Assignee: Exxon Research and Engineering Co., Florham Park, N.J.

[21] Appl. No.: 318,171

[22] Filed: Nov. 4, 1981

[51] Int. Cl.[3] ..... C10G 1/08; C10G 37/14; C10G 31/00; B01J 37/00

[52] U.S. Cl. ..... 208/10; 423/61; 423/62; 423/68; 423/22; 423/49; 502/22

[58] Field of Search ..... 208/10; 252/442; 423/22, 49, 61, 62, 68

[56] References Cited

U.S. PATENT DOCUMENTS

| | | | |
|---|---|---|---|
| 3,214,346 | 10/1965 | Mason et al. | 423/68 X |
| 3,539,290 | 11/1970 | Erickson . | |
| 3,813,329 | 5/1974 | Gatsis . | |
| 3,826,809 | 7/1974 | Hardwich et al. | 423/62 X |
| 3,923,634 | 12/1975 | Silvestri et al. . | |
| 4,145,397 | 3/1979 | Toida et al. | 423/61 X |
| 4,167,555 | 9/1979 | Gomes et al. | 423/61 X |
| 4,224,137 | 9/1980 | Schroeder . | |
| 4,228,033 | 10/1980 | Yamauchi et al. | 252/412 |
| 4,243,639 | 1/1981 | Haas et al. | 423/68 X |
| 4,296,077 | 10/1981 | Heuer et al. | 423/61 X |
| 4,374,100 | 2/1983 | Sefenik et al. | 208/10 X |

*Primary Examiner*—William G. Wright
*Attorney, Agent, or Firm*—Yale S. Finkle

[57] ABSTRACT

Metal constituents are recovered from the heavy bottoms produced during the liquefaction of coal and similar carbonaceous solids in the presence of a catalyst containing a metal capable of forming an acidic oxide by burning the heavy bottoms in a combustion zone at a temperature below the fusion temperature of the ash to convert insoluble metal-containing catalyst residues in the bottoms into soluble metal-containing oxides; contacting the oxidized solids formed in the combustion zone with an aqueous solution of a basic alkali metal salt to extract the soluble metal-containing oxides in the form of soluble alkali metal salts of the metal-containing oxides and recycling the soluble alkali metal salts to the liquefaction zone. In a preferred embodiment of the invention, the bottoms are subjected to partial oxidation, pyrolysis, coking, gasification, extraction or a similar treatment process to recover hydrocarbon liquids and/or gases prior to the burning or combustion step.

20 Claims, 1 Drawing Figure

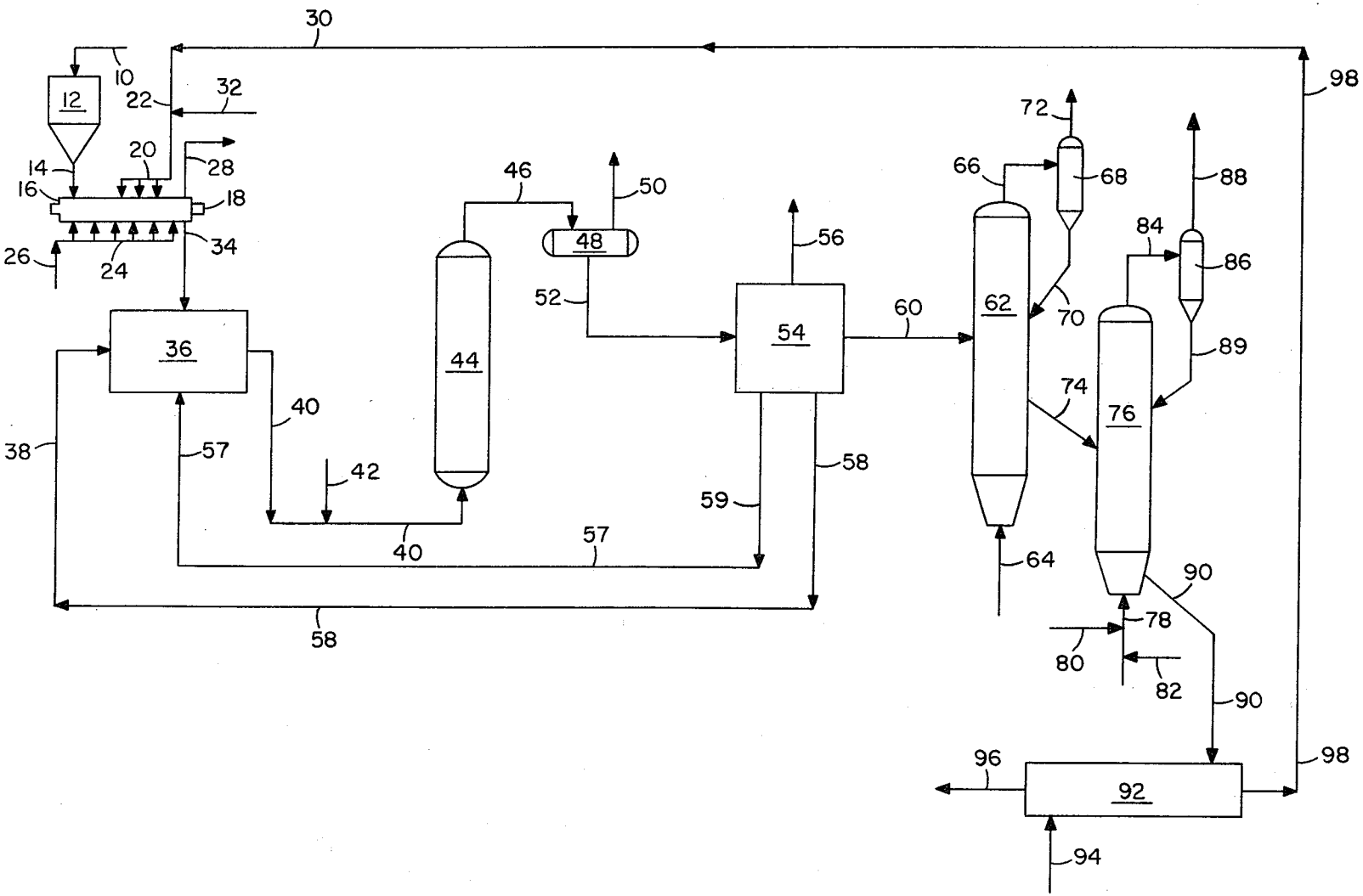
10
12
14
16
18
20
22
24
26
28
30
32
34
36
38
40
42
44
46
48
50
52
54
56
57
58
59
60
62
64
66
68
70
72
74
76
78
80
82
84
86
88
89
90
92
94
96
98

RECOVERY OF COAL LIQUEFACTION CATALYSTS

BACKGROUND OF THE INVENTION

This invention relates to the liquefaction of carbonaceous solids such as coal in the presence of a metal-containing hydrogenation catalyst, and is particularly concerned with the recovery of the metal constituents from the residues produced during the liquefaction process and their uses as constituents of the metal-containing catalyst.

Processes for the direct liquefaction of coal and similar carbonaceous solids normally require contacting of the solid feed material with a hydrocarbon solvent and molecular hydrogen at elevated temperature and pressure to break down the complex high molecular weight hydrocarbon starting material into lower molecular weight liquid and gases. Schemes for employing catalysts to promote the liquefaction and hydrogenation of coal in such processes have been disclosed in the prior art. Metals known to be effective catalytic constituents include cobalt, iron, manganese, molybdenum and nickel. These metals may be added directly into the liquefaction zone in the form of water-soluble or oil-soluble compounds, or compounds containing the metals may be directly impregnated onto the carbonaceous feed material. In some cases, the metal-containing compound may be added to the liquefaction zone in the form of a supported catalyst by impregnating the metal-containing compound onto an inert support such as silica or alumina. Since the metals that comprise the catalyst which is eventually formed in the liquefaction zone tend to be expensive, it is necessary to recover the metal constituents for recycle to the liquefaction zone.

Processes have been proposed in the past for separating the metal catalyst constituents from the solid residue of carbonaceous material left after the feed has been converted in the liquefaction zone and the products processed for the recovery of liquids. In one such process it is proposed to pass the liquefaction residue to a synthesis gas generator to produce molten ash containing the catalyst constituents and then treating the molten ash with chlorine or oxygen to convert the metal catalyst constituents to a volatile compound which can be easily recovered. This process is undesirable because of the high temperatures needed to generate the molten ash and volatilize the catalyst constituents. It has also been proposed to recover the metal catalyst constituents by first subjecting the residues from the liquefaction zone to a carbonization step, burning the resultant char and treating the oxidized char from the burning step with a liquid solution of phosphoric or silicic acid to form a heteropoly acid which can then be reused as the catalyst. This technique is disadvantageous because the acid will extract, in addition to the metal catalyst constituents, large amounts of alumina and other metals such as iron from the oxidized char. The alumina and other metals must be separated from the extracted metal catalyst consituents before these constituents can be reused and this adds appreciably to the cost of the process. It is clear that a more efficient method of recovering the metal-containing catalyst constituents is needed.

SUMMARY OF THE INVENTION

The present invention provides an improved process for the recovery of metal constituents from carbonaceous residues produced during the liquefaction of coal and similar carbonaceous solids carried out in the presence of metal-containing catalysts that at least in part avoids the difficulties referred to above. In accordance with the invention, it has now been found that metal constituents of the catalyst can be effectively recovered from the heavy bottoms stream containing carbonaceous material, insoluble metal-containing catalyst residues and ash produced during the liquefaction of coal and similar carbonaceous materials in the presence of a catalyst containing a metal capable of forming an acidic oxide by burning the bottoms in a combustion zone at a temperature below the fusion temperature of the ash to convert the insoluble metal-containing catalyst residues into soluble metal-containing oxides. The oxidized solids exiting the combustion zone are then contacted with an aqueous solution of a basic alkali metal salt to extract the soluble metal-containing oxides from the oxidized solids in the form of soluble alkali metal salts of the metal-containing oxide. These soluble alkali metal salts are then recycled to the liquefaction zone. The liquefaction of the carbonaceous solids in the presence of the metal-containing catalyst may be carried out by contacting the solids with a hydrogen-containing gas and/or an added hydrocarbon solvent. In some cases where molecular hydrogen is used as the hydrogen-containing gas, an added solvent will not be required. Similarly, in cases where a hydrogen–donor diluent is used as the added hydrocarbon solvent, it may not be necessary to use a hydrogen-containing gas.

In a preferred embodiment of the invention the heavy bottoms stream containing carbonaceous material, insoluble metal-containing catalyst residues and ash is further treated to convert a portion of the carbonaceous material to valuable hydrocarbon liquids and/or gases prior to subjecting the bottoms to the burning or combustion step. The further treatment may consist of a variety of conversion processes including pyrolysis, gasification, coking, partial oxidation and the like. In all of these processes the heavy bottoms stream is heated to a high temperature in the presence or absence of a reactive gas such as steam, hydrogen, oxygen or mixtures thereof in order to convert a portion of the carbon in the bottoms into gases and/or liquids which are then recovered as byproducts. The char residue from this conversion step will contain a small amount of carbonaceous material, insoluble metal-containing catalyst residues and ash and is then oxidized in a combustion zone to convert the insoluble metal-containing catalyst residues into soluble metal-containing oxides.

The process of the invention results in the effective and efficient recovery of metal constituents from the insoluble metal-containing catalyst residues produced during the catalytic liquefaction of coal and similar carbonaceous materials. As a result, the invention makes possible a substantial savings in liquefaction processes carried out in the presence of metal-containing hydrogenation or liquefaction catalysts.

BRIEF DESCRIPTION OF THE DRAWING

The drawing is a schematic flow diagram of a catalytic liquefaction process in which metal constituents of the catalyst are recovered and reused in the process.

DESCRIPTION OF THE PREFERRED EMBODIMENTS

The process depicted in the drawing is one for the liquefaction of bituminous coal, subbituminous coal, lignitic coal, coal char, organic wastes, oil shale, petroleum residua, liquefaction bottoms, tar sand bitumens and similar carbonaceous solids in the presence of a hydrogenation or liquefaction catalyst containing a metal capable of forming an acidic oxide. Such metals include molybdenum, vanadium, tungsten, chromium, niobium, rhenium, ruthenium and the like. Preferably, the metal used as the catalyst constituent will be molybdenum. The solid feed material that has been crushed to a particle size of about 8 mesh or smaller on the U.S. Sieve Series Scale is passed into line 10 from a feed preparation plant or storage facility that is not shown in the drawing. The solids introduced into line 10 are fed into a hopper or similar vessel 12 from which they are passed through line 14 into feed preparation zone 16. This zone contains a screw conveyor or similar device, not shown in the drawing, that is powered by a motor 18, a series of spray nozzles or similar devices 20 for the spraying of a metal-containing solution supplied through line 22 onto the solids as they are moved through the preparation zone by the conveyor, and a similar set of nozzles or the like 24 for the introduction of a hot dry gas such as flue gas into the preparation zone. The hot gas, supplied through line 26, serves to heat the impregnated solids and drive off the moisture. A mixture of water vapor and gas is withdrawn from zone 16 through line 28 and passed to a condensor, not shown, from which water may be recovered for use as makeup or the like. The majority of the metal-containing solution is recycled through line 30 from the metal recovery portion of the process, which is described in more detail hereinafter. Any makeup metal-containing solution required may be introduced into line 22 via line 32.

It is preferred that sufficient metal-containing solution be introduced into preparation zone 16 to provide from about 20 to about 20,000 ppm of the metal or mixture of metals on the coal or other carbonaceous solids. From about 100 to about 1000 ppm is generally adequate. The dried impregnated solid particles prepared in zone 16 are withdrawn through line 34 and passed into slurry preparation zone 36 where they are mixed with a hydrocarbon solvent introduced into the preparation zone through line 38 and, in some cases, recycle liquefaction bottoms introduced through line 57.

The hydrocarbon solvent used to prepare the slurry in slurry preparation zone 36 is preferably a non-hydrogen donor diluent which contains less than about 0.8 weight percent donatable hydrogen, based on the weight of the solvent. Such a non-hydrogen donor solvent may be a heavy hydrocarbonaceous oil or a light hydrocarbonaceous compound or mixture of compounds having an atmospheric pressure boiling point ranging from about 350° F. to about 1000° F., preferably from about 700° F. to about 1000° F. Examples of suitable heavy hydrocarbonaceous oils include heavy mineral oils, whole or topped petroleum crude oils, asphaltenes, residual oils such as petroleum atmospheric tower residua and petroleum vacuum distillation tower residua, tars, shale oils and the like. Suitable light non-hydrogen donor diluents include aromatic compounds such as alkylbenzenes, alkylnaphthalenes, alkylated polycyclic aromatics and mixtures thereof and streams such as unhydrogenated creosote oil, intermediate product streams from catalytic cracking of petroleum feed stocks, coal derived liquids, shale oil and the like. Preferably, the non-hydrogen donor diluent will be a recycle solvent derived within the process by liquefying the carbonaceous feed material and then fractionating the effluent from the liquefaction zone.

In some instances, it may be desirable to use a hydrogen donor diluent as the solvent. Such diluents will normally contain at least 0.8 weight percent donatable hydrogen, based on the weight of the diluent. Preferably, the donatable hydrogen concentration will range between about 1.2 and about 3 weight percent. The hydrogen donor diluent employed will normally be derived within the process in the same manner as the preferred non-hydrogen donor diluent except that the stream will be externally hydrogenated before recycling to the slurry preparation zone. The hydrogen donor diluent will normally contain at least 20 weight percent of compounds that are recognized as hydrogen donors at elevated temperatures generally employed in coal liquefaction reactors. Representative compounds of this type include $C_{10}$–$C_{12}$ tetrahydronaphthalenes, $C_{10}$–$C_{13}$ acenaphthenes, di, tetra- and octahydroanthracenes, tetrahydroacenaphthenes, and other derivatives of partially hydrogenated aromatic compounds.

Sufficient hydrocarbon solvent is introduced into slurry preparation zone 36 to provide a weight ratio of solvent to metalimpregnated carbonaceous feed solids of between about 0.4:1 and about 4:1, preferably from about 1.2:1 to about 1.8:1. The slurry formed in the preparation zone is withdrawn through line 40; mixed with a hydrogen-containing gas, preferably molecular hydrogen, introduced into line 40 via line 42; preheated to a temperature above about 600° F.; and passed upwardly in plug flow through liquefaction reactor 44. The mixture of slurry and hydrogen-containing gas will contain from about 2 to about 15 weight percent, preferably from about 4 to about 9 weight percent hydrogen on a moisture-free solids basis. The liquefaction reactor is maintained at a temperature between about 650° F. and about 900° F., preferably between about 800° F. and about 880° F., and at a pressure between about 300 psig and about 3000 psig, preferably between about 1500 psig and about 2500 psig. Although a single liquefaction reactor is shown in the drawing as comprising the liquefaction zone, a plurality of reactors arranged in parallel or series can also be used, providing the temperature and pressure in each reactor remain approximately the same. Such will be the case if it is desirable to approximate a plug flow situation. Normally, a fluidized bed is not utilized in the reaction zone. The slurry residence time within reactor 44 will normally range between about 15 minutes and about 125 minutes, preferably between about 30 and about 70 minutes.

Within the liquefaction zone in reactor 44, the carbonaceous solids undergo liquefaction or chemical conversion into lower molecular weight constituents. The high molecular weight constituents of the solids are hydrogenated and broken down to form lower molecular weight gases and liquids. The metal constituents which were previously impregnated onto the solid feed material are converted into a hydrogenation or liquefaction catalyst in situ. This metal-containing catalyst promotes the in situ hydrogenation of the hydrocarbon solvent to convert aromatics into hydroaromatics thereby increasing the donatable hydrogen content in the solvent. This in turn results in an increased conversion of the feed solids into lower molecular weight liquids. The metal-containing catalyst also promotes the direct hydrogenation of the solids structure and organic radicals generated by the cracking of the molecules comprising the carbonaceous solids.

As mentioned previously, the metal which comprises the metal constituents impregnated onto the feed solids in preparation zone 16 is a metal capable of forming an acidic oxide. The actual metal-containing compound or compounds in the solution introduced into the feed preparation zone can be any compound or compounds which will be converted under liquefaction conditions into metal constituents which are active hydrogenation or liquefaction catalysts. The metal itself may include any of the metals found in Group II-B, IV-B, V-B, VI-B, VII-B and VIII of the Periodic Table of Elements that will, under proper conditions, form soluble acidic oxides. Such metals include molybdenum, vanadium, tungsten, chromium, niobium, ruthenium, rhenium, osmium and the like. The most preferred metal is molybdenum.

During the liquefaction process which takes place in liquefaction reactor 44, the metal constituents in the soluble compounds impregnated on the coal or similar carbonaceous solids are believed to be converted in situ into an active metal-containing hydrogenation or liquefaction catalyst. It is believed that the metal is converted into metal sulfides which then serve as the catalyst. Regardless of the chemistry that takes place in the liquefaction zone, the metal is converted into metal-containing compounds that are insoluble in organic or inorganic liquids and exit the liquefaction zone with the heavy materials produced therein. To improve the economics of the liquefaction process described above where insoluble metal-containing catalyst residues are formed, it is desirable to recover as much as possible of the metal constituents from the insoluble residues and reuse them as constituents of the catalyst in the liquefaction process, thereby decreasing the amount of costly makeup metal compounds needed. It has been found that a substantial amount of the metal constituents in the insoluble metal-containing catalyst residues withdrawn with the heavy bottoms from the liquefaction zone can be recovered for reuse by burning the heavy bottoms at a temperature below the fusion temperature of its ash to convert the insoluble metal-containing catalyst residues into soluble metal-containing oxides and then contacting the resultant oxidized bottoms with an aqueous solution of a basic alkali metal salt to extract the soluble metal-containing oxides in the form of soluble alkali salts of the metal-containing oxides. These recovered soluble alkali metal salts are then utilized to supply the metal constituents in the liquefaction zone that comprise the hydrogenation or liquefaction catalyst.

Referring again to the drawing, the effluent from liquefaction reactor 44, which contains gaseous liquefaction products such as carbon monoxide, carbon dioxide, ammonia, hydrogen, hydrogen sulfide, methane, ethane, ethylene, propane, propylene and the like; unreacted hydrogen from the feed slurry, light liquids; and heavier liquefaction products including ash, unconverted carbonaceous solids, high molecular weight liquids and insoluble metal-containing catalyst residues, is withdrawn from the top of the reactor through line 46 and passed to separator 48. Here the reactor effluent is separated, preferably at liquefaction pressure, into an overhead vapor steam which is withdrawn through line 50 and a liquid stream removed through line 52. The overhead vapor steam is passed to downstream units where the ammonia, hydrogen and acid gases are separated from the low molecular weight gaseous hydrocarbons, which are recovered as valuable by-products. Some of these light hydrocarbons, such as methane and ethane, may be steam reformed to produce hydrogen that can be recycled where needed in the process.

The liquid stream removed from separator 48 through line 52 will normally contain low molecular weight liquids, high molecular weight liquids, mineral matter or ash, unconverted carbonaceous solids and insoluble metal-containing catalyst residues. This stream is passed through line 52 into fractionation zone 54 where the separation of lower molecular weight liquids from the high molecular weight liquids boiling above 1000° F. and solids is carried out. Normally, the fractionation zone will be comprised of an atmospheric distillation column in which the feed is fractionated into an overhead fraction composed primarily of gases and naphtha constituents boiling up to about 350° F. and intermediate liquid fractions boiling within the range from about 350° F. to about 700° F. The bottoms from the atmospheric distillation column is then passed to a vacuum distillation column in which it is further distilled under reduced pressure to permit the recovery of an overhead fraction of relatively light liquids and heavier intermediate fractions boiling below 850° F. and 1000° F. Several of the distillate streams from both the atmospheric distillation column and the vacuum distillation column are combined and withdrawn as product from the fractionation zone through line 56. A portion of the liquids produced in the fractionation zone are also withdrawn through line 58 and recycled through line 38 for use as the hydrocarbon solvent in slurry preparation zone 36. Normally, these liquids will have a boiling point range from about 350° F. to about 1000° F.

A portion of the heavy bottoms from the vacuum distillation column, which consists primarily of high molecular weight liquids boiling above about 1000° F., mineral matter or ash, unconverted carbonaceous solids and insoluble metal containing catalyst residues, is withdrawn from fractionation zone 54 through line 59 and recycled to slurry preparation zone 36 via line 57. The remainder of this heavy liquefaction bottoms product is withdrawn from the fractionation zone through line 60. This bottom stream contains a substantial amount of carbon and is normally further converted to recover hydrocarbon liquids and/or gases before the bottoms are treated to recover the metal constituents from the catalyst residues. Although any of a variety of conversion processes may be used on the heavy liquefaction bottoms including extraction, pyrolysis, gasification and coking to recover additional hydrocarbon products, partial oxidation to produce a synthesis gas is normally preferred.

Referring again to the drawing, the heavy liquefaction bottoms in line 60 is passed to partial oxidation reactor 62 where the particles comprising the bottoms are introduced into a fluidized bed of char particles extending upward within the reactor above an internal grid or similar distribution device not shown in the drawing. The char particles are maintained in a fluidized state within the reactor by means of oxygen and steam introduced into the reactor through bottom inlet 64. The steam in the mixture of gases introduced into the bottom of the vessel reacts with carbon in the heavy bottoms to form carbon monoxide and hydrogen. The heat required to supply this highly endothermic reaction of steam with carbon is produced by the reaction of the oxygen introduced into the vessel with a portion of the carbon to produce carbon monoxide and carbon dioxide. Sufficient oxygen is included in the mixture of gases so that the heat produced by the oxidation of carbon in the bottoms fed to the reactor will counterbalance the endothermic heat required to drive the reaction of steam with carbon. The temperature in partial oxidation reactor 62 will normally range from about 1800° F. to about 2900° F., preferably from about 2000° F. to about 2400° F., and the pressure will normally be between about 50 psig and about 500 psig, preferably between about 100 psig and about 300 psig. The reactions taking place within the partial oxidation reactor are controlled so that all of the carbon in the liquefaction bottoms is not consumed. A portion of the carbon is allowed to remain so that the char particles produced in the reactor can be burned in a combustor.

The gas leaving the fluidized bed in partial oxidation reactor 62 passes through the upper section of the reactor, which serves as a disengagement zone where particles too heavy to be entrained by the gas leaving the vessel are returned to the bed. If desired, this disengagement zone may include one or more cyclone separators or the like for the removal of relatively large particles from the gas. The gas withdrawn from the upper part of the reactor through line 66 will normally contain a mixture of carbon monoxide, carbon dioxide, hydrogen, hydrogen sulfide formed from the sulfur contained in the bottoms fed to the reactor and entrained fines. This gas is introduced into cyclone separator or similar device 68 where the fine particulates are removed and returned to the reactor via dip leg 70. The raw product gas from which the fines have been removed is withdrawn overhead from separator 68 through line 72 and passed to downstream processing units in order to recover hydrogen which is recycled to the process through line 42.

The char particles in the fluidized bed in partial oxidation reactor 62 will contain a significantly reduced amount of carbon as compared to the bottoms fed to the reactor, ash and the insoluble metal-containing catalyst residues that were originally in the heavy bottoms stream exiting fractionation zone 54 through line 60. It has been found that these insoluble catalyst residues can be converted into soluble metal-containing oxides by burning the char particles from the partial oxidation reactor. These particles are withdrawn from the fluidized bed in the partial oxidation reactor through transfer line 74, passed through a slide valve, not shown in the drawing, and introduced into a fluidized bed of solids extending upward within combustor 76 above an internal grid or similar distribution device not shown in the drawing. The solids are maintained in the fluidized state within the combustor by means of a mixture of air and flue gas introduced into the combustor through bottom inlet line 78. The fluidizing gases are formed by mixing flue gas in line 80 with air supplied through line 82. Normally, a sufficient amount of flue gas is mixed with the air so that the fluidizing gases entering the bottom of the combustor contain between about 2 and about 20 percent oxygen by volume. The amount of oxygen in the fluidizing gases is controlled so that the temperature in the combustor is between about 1200° F. and about 2400° F., preferably between about 1400° F. and about 1800° F.

In the fluidized bed in combustor 76, the carbon remaining in the char particles fed to the combustor reacts with the oxygen in the fluidizing gases to produce carbon monoxide, carbon dioxide and large quantities of heat. The fluidizing gases absorb a portion of the liberated heat as they pass upward through the combustor. The top of the combustor serves as a disengagement zone where particles too heavy to be entrained by the gas leaving the vessel are returned to the bed. The gas which exits the top of the combustor through line 84 will normally contain carbon monoxide, carbon dioxide, hydrogen, nitrogen, hydrogen sulfide and fine particles of solids. This hot flue gas is passed into cyclone separator or similar device 86 where the fine particulates are removed through dip leg 89 and returned to the combustor. The hot flue gas which is withdrawn from separator 86 through line 88 is normally passed to a waste heat boiler or similar device where the heat in the gas is recovered in the form of steam which can be utilized in the process where needed. Normally, a portion of the cooled flue gas is recycled to combustor 76 through line 80 to dilute the air and thereby control the combustion temperature.

The oxidized solids produced in combustor 76 will contain ash, metal containing oxides formed by the oxidation of the insoluble metal-containing catalyst residues in combustor 76, and little if any carbon. It has been found that the metal constituents can be easily extracted from these oxidized solids by contacting them with an aqueous solution of a basic alkali metal salt. It has been found that such a procedure is preferable to extraction with an acid since the alkaline aqueous solution will normally not extract a substantial number of other constituents from the oxidized solids along with the metal constituents which comprise the metal oxides formed by oxidation of the catalyst residues. By avoiding the extraction of these additional constituents, the process of the invention enables the metal constituents to be easily recovered for reuse as constituents of the liquefaction catalyst without the need for expensive added processing steps to remove the additional solubilized constituents from the resultant extract before the extracted metal constituents can be recycled to the process for reuse.

Referring again to the drawing, the oxidized solids produced in combustor 76 are removed from the fluidized bed through line 90 and passed into extraction zone 92 where they are contacted with an aqueous solution of a basic alkali metal salt introduced into the extraction zone through line 94. During the contacting process that takes place in extraction zone 92, the basic alkali metal salt in the aqueous solution extracts the metal-containing oxides from the oxidized solids in the form of soluble alkali metal salts of the metal-containing oxide. For example, if molybdenum is used as the metal, molybdenum oxide ($MoO_3$) will be formed in combustor 76 and will be converted into an alkali metal molybdate ($M_2MoO_4$) during the extraction step. Similarly, if the metal constituent is vanadium, vanadium oxide ($V_2O_5$) will be formed in combustor 76 and will be converted into an alkali metal vanadate ($MVO_3$) during the extraction step. The extraction zone will normally comprise a single stage or multistage countercurrent extraction system in which the oxidized solids are countercurrently contacted with the aqueous solution introduced through line 94.

The basic alkali metal salt used to form the aqueous solution introduced into extraction zone 92 through line 94 may be any basic salt of an alkali metal. Since the sodium salts tend to be less expensive and more readily available, they are generally preferred. Examples of sodium or potassium salts which may be used in the process include sodium or potassium hydroxide, carbonate, silicate, acetate, borate, phosphate, bicarbonate, sesquicarbonate and the like. In general, the alkali metal solution introduced through line 94 into extraction zone 92 will contain between about 1 weight percent and about 50 weight percent of the alkali metal salt, preferably between about 5 weight percent and about 20 weight percent. The temperature in extraction zone 92 will normally be maintained between about 100° F. and about 400° F., preferably between about 150° F. and about 350° F. The pressure in the extraction zone will normally range between about 0 psig and about 100 psig. The residence time of the solids in the extraction zone will depend upon the temperature and alkali metal salt employed and will normally range between about 5 minutes and about 300 minutes, preferably between about 15 minutes and about 120 minutes.

Under the conditions in extraction zone 92, more than 90 percent of the metal in the metal-containing oxides fed to the extraction zone through line 90 will be extracted in the form of alkali metal salts of metal-containing oxides. The actual amount of the metal extracted will depend upon the basic alkali metal salt that is used to form the solution introduced into the extraction zone through line 94 and the extraction conditions. If a strong base such as sodium hydroxide is used as the extractant, it will also extract a portion of the alumina and silica which comprise the ash in the oxidized solids passed from combustor 76 into the extraction zone. Alkali metal salts that are weaker bases tend to extract lesser amounts of alumina and silica along with the metal constituents. Sodium bicarbonate will extract little if any alumina or silica. None of the basic alkali metal salts will extract the iron or other metals which make up the ash and this is a substantial advantage over using acids to carry out the extraction since iron and other metals are much more difficult to remove from the aqueous solution produced during extraction than are the alumina and silica. Spent solids from which the metal-containing oxides have been substantially removed are withdrawn from the extraction zone through line 96 and may be disposed of as landfill or used for other purposes.

The extracted metal constituents in the form of alkali metal salts of the metal-containing oxides are removed in the form of an aqueous solution from extraction zone 92 through line 98. If the basic alkali metal salt used to carry out the extraction also solubilizes a portion of the alumina and silica comprising the ash in the solids fed to the extraction zone, the solution in line 98 may need to be further treated to lower the pH and thereby precipitate the alumina and silica. This can normally be done by contacting the aqueous solution with carbon dioxide to lower the pH to about 11 or less. The overhead gas from partial oxidation reactor 62 or combustor 76 can be used as a convenient source of carbon dioxide. Normally, the use of sodium carbonate as the basic alkali metal salt will not require such a pH adjustment step. The solution in line 98 is then recycled to feed preparation zone 16 via lines 30, 22 and 20. Here, the coal or similar carbonaceous feed material is impregnated with the alkali metal salts of the metal-containing oxides. These salts then serve as the precursors of the metal-containing hydrogenation ior liquefaction catalyst that is formed in situ in liquefaction reactor 44. If the concentration of the alkali metal salts in the recycle stream is undesirably low, the solution may be concentrated by removing excess water before it is returned to the feed preparation zone. In lieu of recycling the solution to the feed preparation zone, the alkali metal salts can be separated from the solution by evaporation and crystallization, precipitation or other methods and added to the feed material in solid form.

In some cases the alkali metal salts of metal-containing oxides present in the solution withdrawn from extraction zone 92 through line 98 may not be converted in the liquefaction reactor into metal-containing hydrogenation or liquefaction catalysts of high activity. If this is the case, it may be desirable to further treat the aqueous solution in line 98 to transform the alkali metal salts into compounds that will be converted into more active catalysts. For example, if the metal involved is molybdenum, it may be desirable to treat the aqueous solution in line 98 with phosphoric acid at a temperature between about 75° F. and about 250° F. in order to convert the alkali metal molybdate into phosphomolybdic acid, which can then be impregnated onto the carbonaceous feed material in feed preparation zone 16. If molybdenum is the metal, other compounds into which the alkali metal salts in the solution in line 98 may be converted include ammonium molybdate, ammonium thiomolybdate and molybdenum naphthenate.

It will be apparent from the foregoing that the invention provides a process which makes it possible to economically recover metal constituents from insoluble metal-containing catalyst residues formed during the liquefaction of coal and similar carbonaceous solids in the presence of a metal-containing catalyst. As a result, the need for costly makeup compounds containing metal constituents is reduced, thereby lowering the overall cost of the liquefaction process.

We claim:

1. A process for the liquefaction of coal which comprises:

(a) contacting said coal under liquefaction conditions in a liquefaction zone with a hydrogen-containing gas and/or an added hydrocarbon solvent in the presence of a catalyst containing a metal capable of forming an acidic oxide to produce a liquefaction effluent, wherein said metal salt is introduced into said liquefaction zone in the form of a water-soluble or oil-soluble compound or by impregnation onto said coal;

(b) treating said liquefaction effluent to recover hydrocarbon liquids thereby producing a heavy bottoms containing carbonaceous material comprised of high molecular weight hydrocarbon liquids boiling above about 1000° F. and unconverted carbonaceous solids, insoluble catalyst residues containing said metal, and ash;

(c) burning said heavy bottoms in a combustion zone at a temperature below the fusion temperature of said ash to convert the insoluble metal-containing catalyst residues into soluble metal-containing oxides;

(d) withdrawing oxidized solids containing said soluble metal-containing oxides from said combustion zone;

(e) contacting said oxidized solids with an aqueous solution of a basic alkali metal salt thereby extracting said soluble metal-containing oxides from said oxidized solids in the form of soluble alkali metal salts of said metal-containing oxides; and (f) recycling said soluble alkali metal salts of said metal-containing oxides to said liquefaction zone wherein said metal is reused as constituents of said catalyst.

2. A process as defined by claim 1 wherein said hydrogen-containing gas comprises molecular hydrogen.

3. A process as defined by claim 1 wherein said catalyst contains a metal from Group II-B, Group IV-B, Group V-B, Group VI-B, Group VII-B or Group VIII of the Periodic Table of Elements.

4. A process as defined by claim 1 wherein said catalyst contains a metal selected from the group consisting of molybdenum, vanadium, tungsten, chromium, rhenium, ruthenium and niobium.

5. A process as defined by claim 4 wherein said metal comprises molybdenum.

6. A process as defined by claim 1 wherein said heavy bottoms is treated to recover hydrocarbon liquids and/or gases prior to being burned in said combustion zone.

7. A process as defined by claim 1 wherein said basic alkali metal salt comprises a sodium salt.

8. A process as defined by claim 7 wherein said sodium salt is selected from the group consisting of sodium hydroxide, sodium carbonate, sodium bicarbonate, sodium acetate, sodium borate, sodium sesquicarbonate and sodium phosphate.

9. A process as defined by claim 8 wherein said sodium salt is sodium hydroxide or sodium carbonate.

10. A process as defined by claim 5 wherein said basic alkali metal salt comprises sodium hydroxide or sodium carbonate, said soluble metal-containing oxides comprise molybdenum oxide and said soluble alkali metal salts of said metal-containing oxides comprise sodium molybdate.

11. A process as defined by claim 1 wherein said soluble alkali metal salts of said metal-containing oxides are converted into metal-containing compounds which yield more active catalysts in said liquefaction zone prior to recycling said soluble alkali metal salts to said liquefaction zone.

12. A process for the liquefaction of coal which comprises:

(a) contacting said coal under liquefaction conditions in a liquefaction zone with molecular hydrogen and an added hydrocarbon solvent in the presence of a catalyst containing a metal capable of forming an acidic oxide to produce a liquefaction effluent, wherein said metal is introduced into said liquefaction zone in the form of a water-soluble or oil-soluble compound or by impregnation onto said coal;

(b) treating said liquefaction effluent to recover hydrocarbon liquids thereby producing a heavy bottoms containing carbonaceous material comprised of high molecular weight hydrocarbon liquids boiling above about 1000° F. and unconverted carbonaceous solids, insoluble catalyst residues containing said metal, and ash;

(c) treating said heavy bottoms at an elevated temperature to recover hydrocarbon liquids and/or gases, thereby forming char particles containing carbonaceous material, insoluble catalyst residues containing said metal and ash;

(d) burning said char particles in a combustion zone at a temperature below the fusion temperature of said ash to convert the insoluble metal-containing catalyst residues into soluble metal-containing oxides;

(e) withdrawing oxidized solids containing said soluble metal-containing oxides from said combustion zone;

(f) contacting said oxidized solids with an aqueous solution of a basic alkali metal salt thereby extracting said soluble metal-containing oxides from said oxidized solids to form an aqueous solution containing soluble alkali metal salts of said metal-containing oxides; and (g) recycling said soluble alkali metal salts of said metal-containing oxides in said aqueous solution to said liquefaction zone wherein said metal is reused as constituents of said catalyst.

13. A process as defined by claim 12 wherein the treatment of step (a) comprises partial oxidation, pyrolysis, coking, gasification or extraction.

14. A process as defined by claim 13 wherein the treatment of step (a) comprises partial oxidation.

15. A process as defined by claim 12 wherein said metal comprises molybdenum.

16. A process as defined by claim 12 wherein said basic alkali metal salt is selected from the group consisting of sodium hydroxide, sodium carbonate, sodium bicarbonate, sodium acetate, sodium phosphate, sodium sesquicarbonate and sodium borate.

17. A process as defined by claim 12 wherein the pH of said aqueous solution containing said soluble alkali metal salts produced in step (d) is lowered in order to precipitate alumina and silica, and the resulting solution is then recycled to the said liquefaction process.

18. A process as defined by claim 15 wherein said basic alkali metal salt comprises sodium hydroxide or sodium carbonate, said soluble metal-containing oxides comprise molybdenum oxide and said soluble alkali metal salts of said metal-containing oxides comprise sodium molybdate.

19. A process as defined by claim 12 wherein said soluble alkali metal salts of said metal-containing oxides in said aqueous solution produced in step (d) are converted into metal-containing compounds which yield more active catalysts in said liquefaction zone prior to recycling said soluble alkali metal salts to said liquefaction zone.

20. A process as defined by claim 18 wherein said sodium molybdate is contacted with phosphoric acid to produce phosphomolybdic acid which is then recycled to said liquefaction zone.

* * * * *